US006694708B2

(12) United States Patent
Brizzi et al.

(10) Patent No.: US 6,694,708 B2
(45) Date of Patent: Feb. 24, 2004

(54) METHOD AND MACHINE FOR PRODUCING A RIGID PACKET OF CIGARETTES

(75) Inventors: Marco Brizzi, Zola Predosa (IT); Michele Squarzoni, Ferrara (IT); Fiorenzo Draghetti, Medicina (IT)

(73) Assignee: G.D Societa' Per Azioni, Bologna (IT)

( * ) Notice: Subject to any disclaimer, the term of this patent is extended or adjusted under 35 U.S.C. 154(b) by 0 days.

(21) Appl. No.: 10/238,334

(22) Filed: Sep. 10, 2002

(65) Prior Publication Data

US 2003/0093977 A1 May 22, 2003

(30) Foreign Application Priority Data

Sep. 14, 2001 (IT) ..... BO2001A000553

(51) Int. Cl.[7] ..... B65B 11/00; B65B 41/16

(52) U.S. Cl. ..... 53/462; 53/234; 53/389.2; 53/579; 493/244; 493/409; 493/178

(58) Field of Search ..... 53/462, 466, 234, 53/389.2, 575, 579; 493/178, 244, 409, 410, 435

(56) References Cited

U.S. PATENT DOCUMENTS

| | | | | | |
|---|---|---|---|---|---|
| 2,054,833 | A | * | 9/1936 | Potdevin | 493/244 |
| 2,785,609 | A | * | 3/1957 | Billeb | 493/244 |
| 3,398,660 | A | * | 8/1968 | Watrous | 493/435 |
| 4,273,550 | A | * | 6/1981 | Kamp | 493/244 |
| 4,730,442 | A | * | 3/1988 | Focke et al. | 53/579 |
| 5,755,080 | A | * | 5/1998 | Draghetti et al. | 53/466 |

* cited by examiner

*Primary Examiner*—John Sipos
(74) *Attorney, Agent, or Firm*—Marshall, Gerstein & Borun LLP

(57) ABSTRACT

A method and machine for producing a rigid packet of cigarettes from a flat, substantially rectangular blank; the blank has two main longitudinal crease lines, and a number of transverse crease lines defining, between the two main longitudinal crease lines, central panels having respective lateral wings; the flat blank is fed to a prefolding station where the lateral wings of at least one of the central panels are folded about the respective main longitudinal crease lines; and the blank is subsequently restored to the flat configuration before being fed to a follow-up folding station.

24 Claims, 4 Drawing Sheets

METHOD AND MACHINE FOR PRODUCING A RIGID PACKET OF CIGARETTES

The present invention relates to a method and machine for producing a rigid packet of cigarettes.

In particular, the present invention may be used to advantage for producing what is known commercially as a pillow-type rigid packet of cigarettes, to which the following description refers purely by way of example.

BACKGROUND OF THE INVENTION

In a pillow-type rigid packet of cigarettes of the type described, for example, in Patent Application WO 0043289A1, the front and rear walls each comprise a flat central portion, and two precreased lateral bands, each of which is curved with its concavity facing inwards to connect the central portion to the corresponding lateral wall along a relative sharp edge, and forms with the lateral wall a respective substantially obtuse dihedral angle.

Pillow-type packets of cigarettes are currently produced on standard cigarette packing machines which, however, have been found to produce good, but not superior, quality pillow-type packets.

SUMMARY OF THE INVENTION

It is an object of the present invention to provide a method of producing a rigid packet of cigarettes, designed to eliminate the aforementioned drawbacks and which at the same time is cheap and easy to implement.

According to the present invention, there is provided a method of producing a substantially parallelepiped-shaped rigid packet of cigarettes comprising a front wall and a rear wall opposite and substantially parallel to each other, and a pair of lateral walls opposite and substantially parallel to each other and substantially perpendicular to the front wall and the rear wall; the front wall and the rear wall each being connected to each of the lateral walls at a single respective sharp edge; the method comprising the steps of feeding a flat, substantially rectangular blank to a folding station, and folding the blank about an orderly group of cigarettes at the folding station; the blank comprising two main longitudinal crease lines, and a number of transverse crease lines defining, between said two main longitudinal crease lines, at least a first central panel eventually forming part of said front wall, and a second central panel eventually forming said rear wall; said two main longitudinal crease lines defining, on opposite sides of each said central panel, at least two respective lateral wings eventually forming part of said lateral walls; and the method being characterized by feeding the flat blank to a prefolding station upstream from said folding station; folding, at said prefolding station, the lateral wings of at least one said central panel about the respective main longitudinal crease lines; and restoring the blank to the flat configuration before feeding the blank to said folding station.

The present invention also relates to an automatic machine for producing a rigid packet of cigarettes.

According to the present invention, there is provided a packing machine for producing a substantially parallelepiped-shaped rigid packet of cigarettes comprising a front wall and a rear wall opposite and substantially parallel to each other, and a pair of lateral walls opposite and substantially parallel to each other and substantially perpendicular to the front wall and the rear wall; the front wall and the rear wall each being connected to each of the lateral walls at a single respective sharp edge; the packing machine comprising a folding station, conveying means for feeding a flat, substantially rectangular blank to the folding station, and first folding devices for folding the blank about an orderly group of cigarettes at the folding station; the blank comprising two main longitudinal crease lines, and a number of transverse crease lines defining, between said two main longitudinal crease lines, at least a first central panel eventually forming part of said front wall, and a second central panel eventually forming said rear wall; said two main longitudinal crease lines defining, on opposite sides of each said central panel, at least two respective lateral wings eventually forming part of said lateral walls; and the packing machine being characterized by comprising a prefolding station upstream from said folding station in the travelling direction of said conveying means; second folding devices for folding, at said prefolding station, the lateral wings of at least one said central panel about the respective main longitudinal crease lines; and third folding devices for restoring the blank to the flat configuration before feeding the blank to said folding station.

BRIEF DESCRIPTION OF THE DRAWINGS

A nonlimiting embodiment of the present invention will be described by way of example with reference to the accompanying drawings, in which.

DETAILED DESCRIPTION OF THE INVENTION

Figure 1:
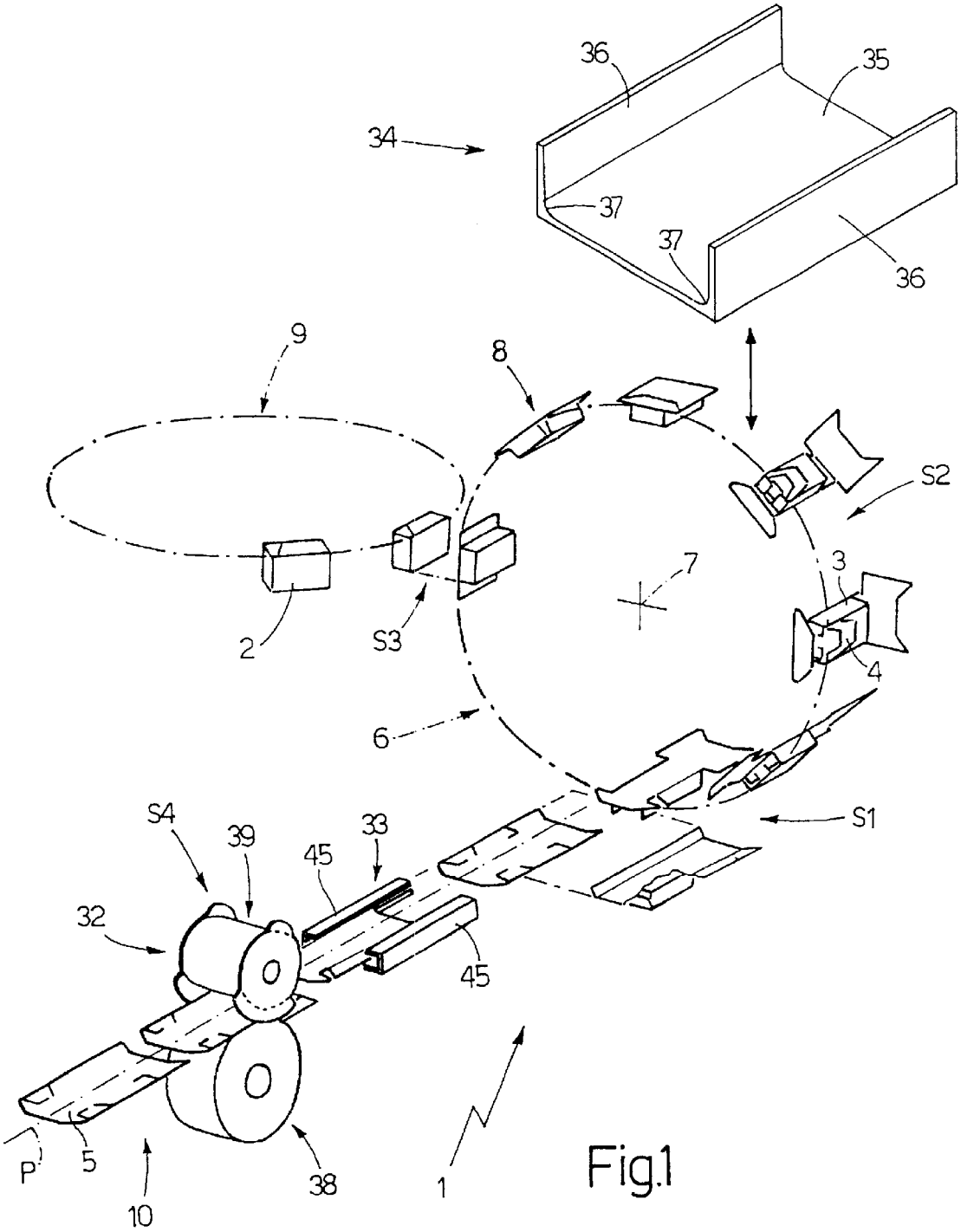
FIG. 1 shows a schematic view in perspective of an automatic cigarette packing machine in accordance with the present invention.

Number 1 in FIG. 1 indicates an automatic packing machine (shown partly and schematically) for producing rigid hinged-lid packets 2 of cigarettes. Each packet 2 comprises an orderly group 3 of cigarettes wrapped in a respective sheet of foil wrapping material; a collar 4 about group 3 and over the sheet of foil wrapping material; and a blank 5 folded about group 3.

Packing machine 1 comprises a substantially known vertical packing wheel 6, in particular of the type featured on the automatic packing machine marketed by G.D. S.p.A. under the trade name "X2." Packing wheel 6 rotates in steps about a horizontal axis 7, and comprises a number of seats 8 arranged symmetrically along the periphery of packing wheel 6. Each seat 8 is fed cyclically by packing wheel 6 along a circular path and through an input station S1, where seat 8 is fed with a respective blank 5 and a respective group 3 of cigarettes wrapped in a respective sheet of foil wrapping material and fitted with a respective collar 4; through a series of successive packing stations S2, where blank 5 is gummed and folded about group 3 of cigarettes to form a respective packet 2; and through an output station S3, where the finished packet 2 is fed to a follow-up drying wheel 9.

Blanks 5 are transferred to input station S1 by a-straight conveyor 10, which comprises a series of known fixed rails (not shown) for guiding blanks 5 along a path P; and a number of known transfer rollers (not shown) for pushing blanks 5 along the fixed rails.

Figures 4, 5, 6:
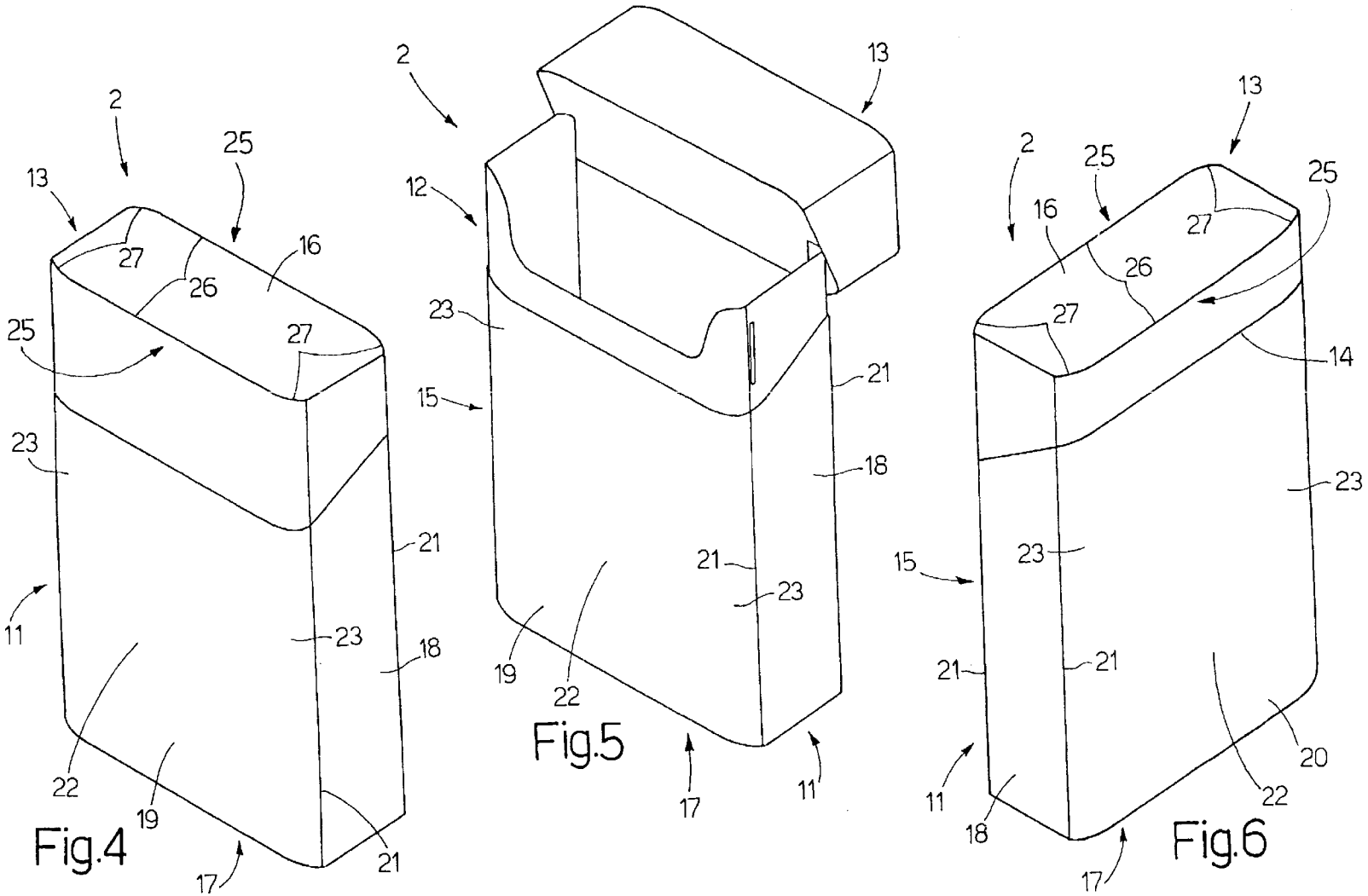
FIG. 4 shows a front view in perspective of a packet of cigarettes produced on the FIG. 1 packing machine and in the closed configuration.
FIG. 5 shows a front view in perspective of the FIG. 4 packet in the open configuration.
FIG. 6 shows a rear view in perspective of the FIG. 4 packet in the closed configuration.

FIGS. 4, 5 and 6 show larger-scale views in perspective of a packet 2 of cigarettes produced on packing machine 1 and of the so-called pillow type substantially described in Patent Application WO 0043289A1. Packet 2 comprises a cup-shaped bottom container 11 having an open top end 12; and a cup-shaped top lid 13 hinged to container 11 along a hinge 14 to rotate, with respect to container 11, between an open position (FIG. 5) and a closed position (FIG. 4) respectively opening and closing end 12.

In the closed position, lid 13 imparts to packet 2 a substantially rectangular parallelepiped shape defined by a lateral surface 15, and by two facing, respectively top and bottom, end walls 16 and 17, which are flat, identical and parallel and define lateral surface 15.

Lateral surface 15 comprises two parallel, facing, flat lateral walls 18; and a front wall 19 and rear wall 20 facing each other and substantially crosswise to lateral walls 18.

Each of front and rear walls 19 and 20 has an outwardly convex profile, is connected to the two lateral walls 18 along respective sharp edges 21 perpendicular to end walls 16 and 17, and forms, with the two lateral walls 18, respective substantially obtuse dihedral angles.

Each of front and rear walls 19 and 20 comprises a respective flat, substantially rectangular central portion 22; and two lateral bands 23 located on opposite sides of central portion 22 and between portion 22 and corresponding edges 21. Each lateral band 23 is precreased internally by longitudinal crease lines 24, so as to curve with its concavity facing inwards to connect relative central portion 22 to the corresponding lateral wall 18 and so form respective sharp edge 21 and the respective obtuse dihedral angle with lateral wall 18.

Each end wall 16, 17 has two major lateral edges 25, each of which defines the borderline with a respective major lateral wall 19 and comprises a substantially straight central portion 26 corresponding to central portion 22 of front wall 19 or rear wall 20, and two curved lateral portions 27 corresponding to lateral bands 23 of front wall 19 or rear wall 20 (lateral portions 27 are therefore the same shape as each of respective lateral bands 23 in cross section).

In a further embodiment not shown, only front wall 19 or rear wall 20 has an outwardly convex profile, and forms respective substantially obtuse dihedral angles with the two lateral walls 18, while the other rear wall 20 or front wall 19 is flat, and forms right-angles with the two lateral walls 18.

In a further embodiment not shown, front wall 19 and rear wall 20 are flat, while each lateral wall 18 has an outwardly convex profile and forms respective substantially obtuse dihedral angles with front wall 19 and rear wall 20.

In a further embodiment not shown, front wall 19 and rear wall 20 each have a continuously curved outwardly convex profile. That is, as opposed to a flat central portion and two curved lateral bands, as in the FIGS. 4, 5 and 6 embodiment, front wall 19 and rear wall 20 each have a single, continuously curved surface.

Packet 2 also comprises a respective collar 4, which is folded into a U and fitted (glued) inside cup-shaped container 11 so as to project partly outwards of end 12 and engage a corresponding inner surface of lid 13 when lid 13 is closed (as shown in FIG. 1).

Figure 2:
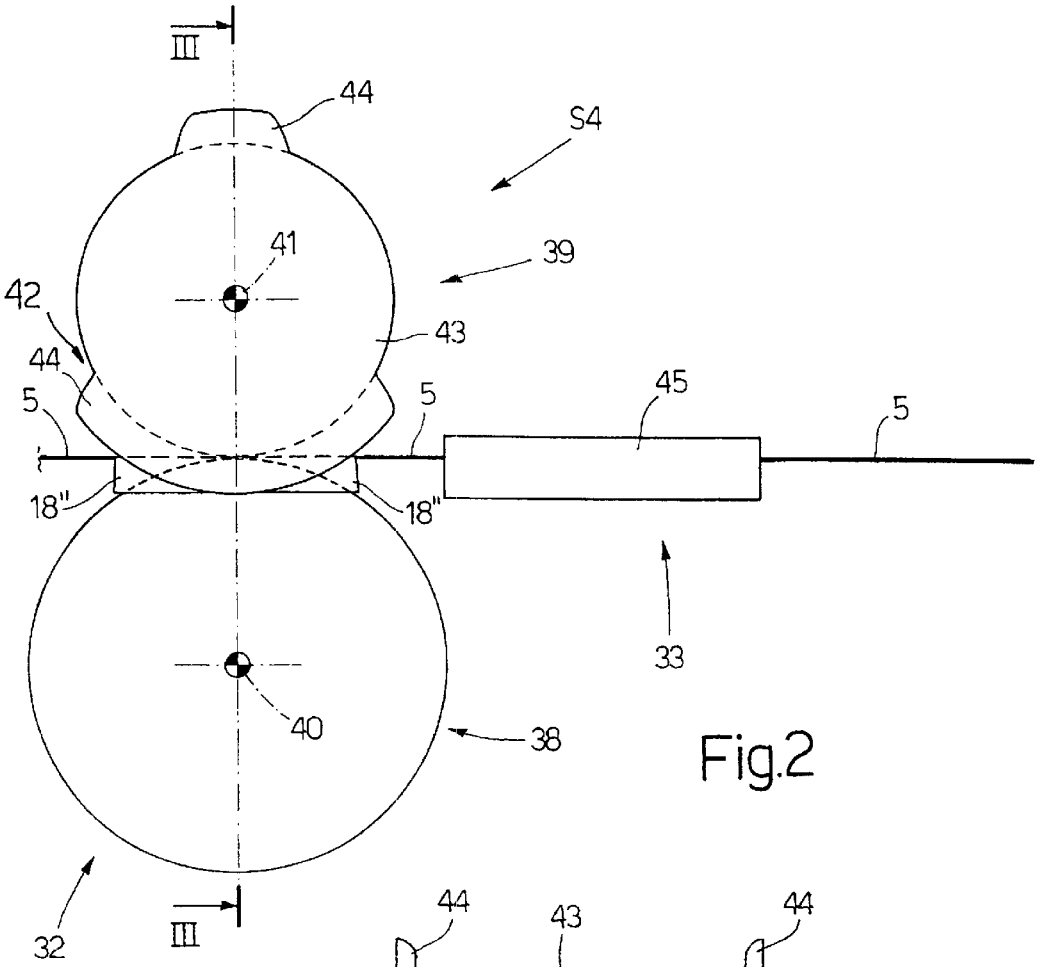
FIG. 2 shows a larger-scale side view of a prefolding station of the automatic machine in FIG. 1.
Figure 7:
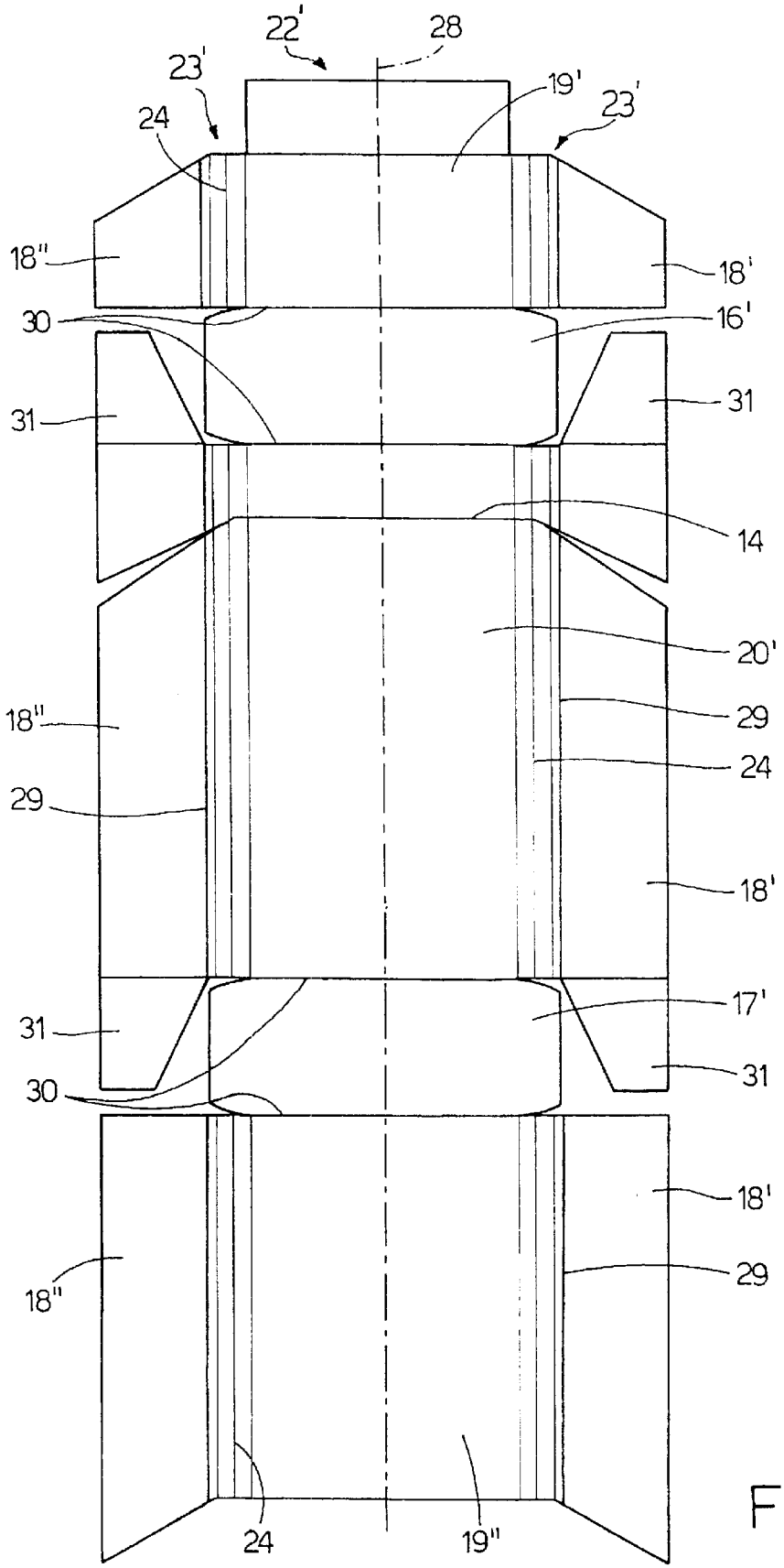
FIG. 7 shows a plan view of a blank used on the FIG. 1 packing machine to produce the FIG. 4 packet.

As shown in FIG. 7, packet 2 in FIGS. 1 and 2 is formed from a corresponding flat, substantially elongated rectangular blank 5, the parts of which are indicated, where possible, using the same reference numbers, with superscripts, as for the corresponding parts of packet 2.

Blank 5 (which has a central longitudinal axis 28) comprises two longitudinal crease lines 29; and a number of transverse crease lines 30 defining, between the two longitudinal crease lines 29, a panel 19' defining a top portion of front wall 19 (and in particular the portion forming part of lid 13), a panel 16' defining top end wall 16, a panel 20' defining rear wall 20, a panel 17' defining bottom end wall 17, and a panel 19" defining a bottom portion of front wall 19 (and in particular, the portion forming part of container 11).

Panels 19', 19" and 20' comprise respective flat central portions 22'; and respective lateral bands 23' located on opposite sides of relative central portions 22' and precreased by respective crease lines 24.

Each panel 19', 19", 20' has two lateral wings 18' and 18" located on opposite sides of panel 19', 19", 20' and separated from panel 19', 19", 20' by longitudinal crease lines 29. Each wing 18', 18" of panel 20' has trapezoidal longitudinal appendixes 31 located at opposite ends of wing 18', 18" and aligned longitudinally with each other.

When forming each packet 2 on packing wheel 6, each lateral wing 18' and corresponding lateral wing 18" are superimposed and glued together to define a respective lateral wall 18 of packet 2; and each longitudinal appendix 31 is folded squarely with respect to the relative lateral wing 18' or 18", and is superimposed on and glued to an inner surface of a relative panel 16' or 17' to define an inner portion of a relative end wall 16 or 17 of packet 2 respectively.

In a preferred embodiment, longitudinal crease lines 29 (also referred to as main longitudinal crease lines) are weaker than longitudinal crease lines 24 (also referred to as secondary longitudinal crease lines) on account of longitudinal crease lines 29 defining the sharp edges 21 of packet 2, whereas longitudinal crease lines 24 serve to slightly curve the lateral bands 23 of front and rear walls 19 and 20 with no sharp edges. To achieve different degrees of weakness, longitudinal crease lines 24 and 29 are defined by respective incisions of different shapes and/or sizes.

As shown in FIG. 1, conveyor 10 feeds blanks 5 successively along straight path P parallel to the longitudinal axes 28 of blanks 5. Along conveyor 10 and upstream from input station S1, a prefolding station S4 is provided comprising two folding members 32 and 33 located successively along the feed path P of blanks 5.

Folding member 32 is located upstream from folding member 33, receives each blank 5 in a flat configuration, and folds lateral wings 18' and 18" of panels 19' and 19" about respective longitudinal crease lines 29, while leaving lateral wings 18' and 18" of panel 20' in the flat configuration. Folding member 33 is located downstream from folding member 32, receives each blank 5 from folding member 32, and, before blank 5 is fed to input station S1, restores blank 5 to the flat configuration by folding lateral wings 18' and 18" of panels 19' and 19" about respective longitudinal crease lines 29 in the opposite direction to the folding operation performed by folding member 32.

In a further embodiment not shown, folding member 32 folds lateral wings 18' and 18" of panels 19', 19" and 20' about respective longitudinal crease lines 29 of each blank 5.

In a preferred embodiment, each seat 8 is defined by a U-shaped folding pocket 34 comprising a bottom wall 35 and two lateral walls 36. At input station S1, each blank 5 is inserted inside respective folding pocket 34, so that panel 20' rests on bottom wall 35, and lateral wings 18' and 18" of panel 20', on contacting lateral walls 36, are folded substantially 90° about respective longitudinal crease lines 29 to assume a U-shaped configuration. The edge 37 between bottom wall 35 and each lateral wall 36 of each folding pocket 34 is shaped to negatively reproduce the shape of lateral bands 23 of rear wall 20 of packet 2. At input station S1, each blank 5 is inserted inside respective folding pocket 34 by a pusher (not shown) shaped to positively reproduce the shape of folding pockets 34 and to engage each folding pocket 34 in die-counterdie manner, so that the rear portion of each packet 2 is shaped correctly by a stamping process as respective blank 5 is inserted inside relative folding pocket 34.

Figure 3:
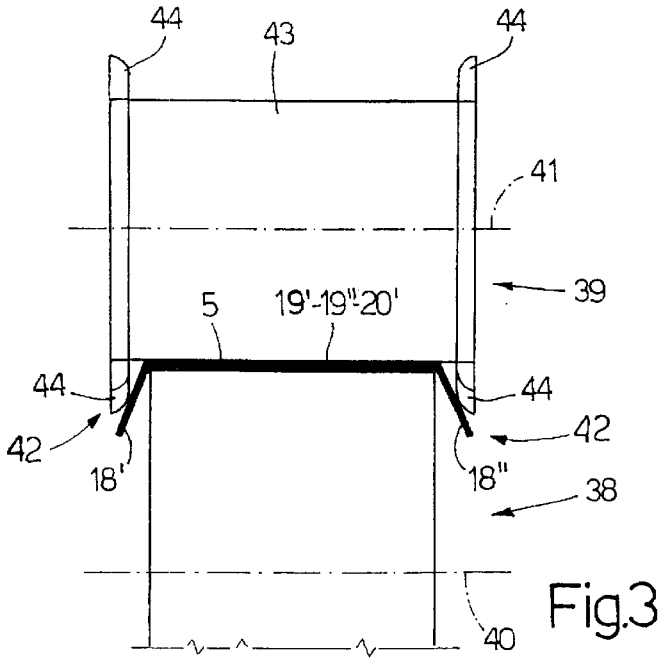
FIG. 3 shows a section along line III—III of the prefolding station in FIG. 2.

As shown in FIGS. 2 and 3, folding member 32 comprises two drums 38 and 39 which rotate synchronously in opposite directions about respective axes 40 and 41 crosswise to path P, and between which each blank 5 is fed. The bottom drum 38 is a contrasting drum, while the top drum 39 is a folding drum with folding bodies 42 for folding lateral wings 18' and 18" about respective longitudinal crease lines 29. More specifically, drums 38 and 39 are shaped and sized to successively engage panels 19', 20' and 19", while leaving respective lateral wings 18' and 18" free. For which purpose, contrasting drum 38 is of an axial width substantially equal to (actually slightly less than) the distance between longitudinal crease lines 29; and folding drum 39 comprises a central body 43 of an axial width at least equal to the distance between longitudinal crease lines 29, and which supports lateral appendixes 44 projecting radially and laterally from central body 43 and defining folding bodies 42.

As shown in FIG. 2, lateral appendixes 44 of folding drum 39 comprise physically separate elements for only folding lateral wings 18' and 18" of panels 19' and 19", while leaving lateral wings 18' and 18" of panel 20' in the flat configuration; and the lateral surface of folding drum 39 has a circumference substantially equal to the length of a blank 5, so as to work one blank 5 at each turn.

Finally, folding members 33 comprise two pairs of substantially known fixed helical folding devices 45 located symmetrically on opposite sides of straight path P to engage and restore to the flat configuration the lateral wings 18' and 18" folded by folding member 32.

Tests have shown that prefolding lateral wings 18' and 18" of panels 19' and 19", i.e., the panels defining front wall 19, of each blank 5, before blank 5 is fed to packing wheel 6, provides for obtaining a high-quality packet 2 in which the lateral bands 23 of front wall 19 are curved correctly and terminate with respective well defined sharp edges 21.

In the case of rear wall 20, on the other hand, correct curvature of lateral bands 23 and well defined respective sharp edges 21 are achieved by stamping blank 5, as described above, inside an appropriately shaped respective folding pocket 34.

Leaving lateral wings 18' and 18" of panel 20' of each blank 5 in the flat configuration (not folding lateral wings 18' and 18" at prefolding station S4) ensures greater rigidity of blank 5 in the panel 20' region when blank 5 is fed into respective folding pocket 34, so that blank 5 is easier to handle and positioned more accurately with respect to folding pocket 34.

The above method of producing a rigid packet of cigarettes is preferably applied to the manufacture of rigid pillow-type packets, but may be used to advantage for manufacturing any rigid packet of cigarettes having sharp longitudinal edges, by the folding of lateral wings 18' and 18" at prefolding station S4 ensuring both well defined edges 21 and a correctly shaped front wall 19 and/or rear wall 20.

What is claimed is:

1. A method of producing a substantially parallelepiped-shaped rigid packet of cigarettes comprising a front wall (19) and a rear wall (20) opposite and substantially parallel to each other, and a pair of lateral walls (18) opposite and substantially parallel to each other and substantially perpendicular to the front wall and the rear wall (19, 20); the front wall and the rear wall (19, 20) each being connected to each of the lateral walls (18) at a single respective sharp edge (21); the method comprising the steps of feeding a flat, substantially rectangular blank (5) to a folding station (S2), and folding the blank (5) about an orderly group (3) of cigarettes at the folding station (S2); the blank (5) comprising two main longitudinal crease lines (29), and a number of transverse crease lines (30) defining, between said two main longitudinal crease lines (29), at least a first central panel (19") eventually forming part of said front wall (19), and a second central panel (20') eventually forming said rear wall (20); said two main longitudinal crease lines (29) defining, on opposite sides of each said central panel (19", 20'), at least two respective lateral wings (18', 18") eventually forming part of said lateral walls (18); and the method being characterized by feeding the flat blank (5) to a prefolding station (S4) upstream from said folding station (S2); folding, at said prefolding station (S4), the lateral wings (18', 18") of at least one said central panel (19", 20') about the respective main longitudinal crease lines (29); and restoring the blank (5) to the flat configuration before feeding the blank (5) to said folding station (S2).

2. A method as claimed in claim 1, characterized by folding, at said prefolding station (S4), the lateral wings (18', 18") of at least said first central panel (19") about the respective main longitudinal crease lines (29).

3. A method as claimed in claim 2, characterized in that said transverse crease lines (30) define, between said two main longitudinal crease lines (29), said first central panel (19") eventually forming a bottom portion of said front wall (19), said second central panel (20') eventually forming said rear wall (20), and a third central panel (19') eventually forming a top portion of said front wall (19); said two main longitudinal crease lines (29) defining, on opposite sides of each said central panel (19', 19", 20'), at least two respective lateral wings (18', 18") eventually forming part of said lateral walls (18); at said prefolding station (S4), the lateral wings (18', 18") of at least said first and said third central panel (19", 19') being folded about the respective main longitudinal crease lines (29).

4. A method as claimed in claim 3, characterized by only folding, at said prefolding station (S4), the lateral wings (18', 18") of said first and said third central panel (19', 19") about the respective main longitudinal crease lines (29); the lateral wings (18', 18") of said second central panel (20') being left in the flat configuration at said prefolding station (S4).

5. A method as claimed in claim 3, characterized by folding the lateral wings (18', 18") of said first, said second, and said third central panel (19", 20', 19') about the respective main longitudinal crease lines (29) at said prefolding station (S4).

6. A method as claimed in claim 4, characterized in that, at said folding station (S2), said flat blank (5) is inserted inside a respective folding pocket (34), in which said second central panel (20') is positioned contacting a bottom wall, and the lateral wings (18', 18") of the second central panel (20') are folded substantially 90° about the respective main longitudinal crease lines (29) to assume a U-shaped configuration.

7. A method as claimed in claim 1, characterized in that said lateral walls (18) are flat walls, while said front and said rear wall (19, 20) are each outwardly convex, are each connected to each of the two adjacent lateral walls (18) along a respective sharp edge (21), and each form, with the two adjacent lateral walls (18), respective substantially obtuse dihedral angles.

8. A method as claimed in claim 7, characterized in that said front and said rear wall (19, 20) each comprise a respective flat central portion (22), and two lateral bands (23) precreased by further secondary longitudinal crease lines (24), each of which is weakened to a lesser degree than said main longitudinal crease lines (29); each lateral band (23) curving with its concavity facing inwards to connect the relative central portion (22) to the corresponding lateral wall (18), and to form with the lateral wall (18) a respective said substantially obtuse dihedral angle; each said central panel (19', 19", 20') comprising a respective flat central portion (22'), and two respective lateral bands (23') precreased by the further secondary longitudinal crease lines (24).

9. A method as claimed in claim 1, characterized in that said front and said rear wall (19, 20) are flat walls, while each of said lateral walls (18) is outwardly convex, is connected to each of the two adjacent front and rear walls (19, 20) along a respective sharp edge (21), and forms, with the two adjacent front and rear walls (19, 20), respective substantially obtuse dihedral angles.

10. A method as claimed in claim 9, characterized in that each of said lateral walls (18) comprises a respective flat central portion, and two lateral bands precreased by further secondary longitudinal crease lines, each of which is weakened to a lesser degree than said main longitudinal crease lines (29); each lateral band curving with its concavity facing inwards to connect the relative central portion to the corresponding front or rear wall (19; 20), and to form with the front or rear wall (19; 20) a respective said substantially obtuse dihedral angle.

11. A packing machine for producing a substantially parallelepiped-shaped rigid packet of cigarettes comprising a front wall (19) and a rear wall (20) opposite and substantially parallel to each other, and a pair of lateral walls (18) opposite and substantially parallel to each other and substantially perpendicular to the front wall and the rear wall (19, 20); the front wall and the rear wall (19, 20) each being connected to each of the lateral walls (18) at a single respective sharp edge (21); the packing machine (1) comprising a folding station (S2), conveying means (10) for feeding a flat, substantially rectangular blank (5) to the folding station (S2), and first folding devices for folding the blank (5) about an orderly group (3) of cigarettes at the folding station (S2); the blank (5) comprising two main longitudinal crease lines (29), and a number of transverse crease lines (30) defining, between said two main longitudinal crease lines (29), at least a first central panel (19") eventually forming part of said front wall (19), and a second central panel (20') eventually forming said rear wall (20); said two main longitudinal crease lines (29) defining, on opposite sides of each said central panel (19", 20'), at least two respective lateral wings (18', 18") eventually forming part of said lateral walls (18); and the packing machine (1) being characterized by comprising a prefolding station (S4) upstream from said folding station (S2) in the traveling direction of said conveying means (10); second folding devices (32) for folding, at said prefolding station (S4), the lateral wings (18', 18") of at least one said central panel (19", 20') about the respective main longitudinal crease lines (29); and third folding devices (33) for restoring the blank (5) to the flat configuration before feeding the blank (5) to said folding station (S2).

12. A machine as claimed in claim 11, characterized in that, at said prefolding station (S4), said second folding devices (32) fold the lateral wings (18', 18") of at least said first central panel (19") about the respective main longitudinal crease lines (29).

13. A machine as claimed in claim 12, characterized in that said transverse crease lines (30) define, between said two main longitudinal crease lines (29), said first central panel (19") eventually forming a bottom portion of said front wall (19), said second central panel (20') eventually forming said rear wall (20), and a third central panel (19') eventually forming a top portion of said front wall (19); said two main longitudinal crease lines (29) defining, on opposite sides of each said central panel (19', 19", 20'), at least two respective lateral wings (18', 18") eventually forming part of said lateral walls (18); said second folding devices (32) folding the lateral wings (18', 18") of at least said first and said third central panel (19", 19') about the respective main longitudinal crease lines (29).

14. A machine as claimed in claim 13, characterized in that said second folding devices (32) only fold the lateral wings (18', 18") of said first and said third central panel (19', 19") about the respective main longitudinal crease lines (29); the lateral wings (18', 18") of said second central panel (20') being left in the flat configuration at said prefolding station (S4).

15. A machine as claimed in claim 11, characterized in that said lateral walls (18) are flat walls, while said front and said rear wall (19, 20) are each outwardly convex, are each connected to each of the two adjacent lateral walls (18) along a respective sharp edge (21), and each form, with the two adjacent lateral walls (18), respective substantially obtuse dihedral angles.

16. A machine as claimed in claim 15, characterized in that said front and said rear wall (19, 20) each comprise a respective flat central portion (22), and two lateral bands (23) precreased by further secondary longitudinal crease lines (24), each of which is weakened to a lesser degree than said main longitudinal crease lines (29); each lateral band (23) curving with its concavity facing inwards to connect the relative central portion (22) to the corresponding lateral wall (18), and to form with the lateral wall (18) a respective said substantially obtuse dihedral angle; each said central panel (19', 19", 20') comprising a said respective flat central portion (22'), and two said respective lateral bands (23') precreased by the further secondary longitudinal crease lines (24).

17. A machine as claimed in claim 15, characterized in that said folding station (S2) comprises a folding pocket (34) for receiving said blank (5) so that said second central panel (20') contacts a bottom wall (35) of the folding pocket (34), and the lateral wings (18', 18") of the second central panel (20') are folded substantially 90° about the respective main longitudinal crease lines (29) to assume a U-shaped configuration.

18. A machine as claimed in claim 17, characterized in that said folding pocket (34) comprises the bottom wall (35) which contacts said second central panel (20'), and a pair of lateral walls (36) which contact said lateral wings (18', 18") of the second central panel (20'); the edge (37) between the bottom wall (35) and each said lateral wall (36) of the folding pocket (34) being shaped to negatively reproduce the shape of said lateral bands of the rear wall (20) of the packet (2).

19. A machine as claimed in claim 18, characterized by comprising a pusher for inserting said blank (5) inside said folding pocket (34), and which is shaped to positively reproduce the shape of the folding pocket (34) and to engage the folding pocket (34) in die-counterdie manner.

20. A machine as claimed in claim 11, characterized in that said conveying means (10) feed said blank (5) along a straight path (P) parallel to said main longitudinal crease lines (29).

21. A machine as claimed in claim 20, characterized in that said second folding devices (32) comprise two drums (38, 39) which rotate synchronously in opposite directions about respective axes (40, 41) crosswise to said path (P), and between which said blank (5) is fed; one drum (38) being a contrasting drum, and the other drum (39) being a folding drum having folding bodies (42) for folding said lateral wings (18', 18") about the respective main longitudinal crease lines (29).

22. A machine as claimed in claim 21, characterized in that said drums (38, 39) are shaped and sized to successively engage said first, said second, and said third central panel (19", 20', 19'), while leaving said lateral wings (18', 18") free; said folding drum (39) having a central body (43) for engaging the first, second, and third central panel (19", 20', 19'), and lateral appendixes (44) which project radially and laterally from the central body (43), engage and fold the lateral wings (18', 18"), and define said folding bodies (42).

23. A machine as claimed in claim 22, characterized in that said lateral appendixes (44) comprise physically separate elements for only folding the lateral wings (18', 18") of said first and said third central panel (19', 19"), and for maintaining the lateral wings (18', 18") of said second central panel (20') in the flat configuration.

24. A machine as claimed in claim 20, characterized in that said third folding devices (33) comprise two pairs of fixed helical folding devices (45) located symmetrically on opposite sides of said straight path (P).

* * * * *